US011673772B2

(12) United States Patent
Hosemann et al.

(10) Patent No.: US 11,673,772 B2
(45) Date of Patent: Jun. 13, 2023

(54) ALIGNING DEVICE AND METHOD FOR ALIGNING A GUIDE RAIL OF AN ELEVATOR SYSTEM

(71) Applicant: Inventio AG, Hergiswil (CH)

(72) Inventors: Axel Hosemann, Auw (CH); Christian Studer, Kriens (CH); Eliza Olczyk, Lucerne (CH)

(73) Assignee: INVENTIO AG, Hergiswil (CH)

( * ) Notice: Subject to any disclaimer, the term of this patent is extended or adjusted under 35 U.S.C. 154(b) by 46 days.

(21) Appl. No.: 17/310,609

(22) PCT Filed: Mar. 13, 2020

(86) PCT No.: PCT/EP2020/056789
§ 371 (c)(1),
(2) Date: Aug. 13, 2021

(87) PCT Pub. No.: WO2020/193186
PCT Pub. Date: Oct. 1, 2020

(65) Prior Publication Data

US 2022/0024722 A1 Jan. 27, 2022

(30) Foreign Application Priority Data

Mar. 26, 2019 (EP) ..... 19165216

(51) Int. Cl.
*B66B 7/02* (2006.01)
*B66B 19/00* (2006.01)

(52) U.S. Cl.
CPC ..... *B66B 7/023* (2013.01); *B66B 7/024* (2013.01); *B66B 19/002* (2013.01)

(58) Field of Classification Search
CPC ..... B66B 7/023; B66B 7/024
See application file for complete search history.

(56) References Cited

U.S. PATENT DOCUMENTS 2,722,294 A * 11/1955 Lagaard ..... E04B 1/58 411/401
3,305,030 A * 2/1967 Martensen ..... A01B 15/02 403/388

(Continued)

FOREIGN PATENT DOCUMENTS

DE 3010826 A1 10/1981
DE 202009014434 U1 2/2010

(Continued)

*Primary Examiner* — Minh Truong
(74) *Attorney, Agent, or Firm* — William J. Clemens; Shumaker, Loop & Kendrick, LLP

(57) ABSTRACT

An aligning device for aligning a guide rail of an elevator system has lower and upper rail bracket parts and at least two movement elements. The lower rail bracket part is fixed to an elevator shaft wall and the upper rail bracket part holds a guide rail. The lower and upper rail bracket parts each have a connecting region for fixing to one another. The movement elements move the lower rail bracket part relative to the upper rail bracket part. Each of the movement elements interacts with both of the connecting regions of the rail bracket parts. Each of the movement elements is rotatable about an axis of rotation and interacts, eccentrically with respect to the axis of rotation, with at least one of the rail bracket parts so as to abut laterally opposite contact surfaces of this rail bracket part.

13 Claims, 6 Drawing Sheets

(56) References Cited

U.S. PATENT DOCUMENTS

| | | | | |
|---|---|---|---|---|
| 3,357,661 | A * | 12/1967 | Aakjar | F16B 5/025 248/662 |
| 6,196,356 | B1 * | 3/2001 | Sneed | B66B 7/024 403/14 |
| 2006/0110234 | A1 * | 5/2006 | Illedits | F16B 39/101 411/166 |
| 2012/0312640 | A1 * | 12/2012 | Bjorni | B66B 7/023 187/408 |

FOREIGN PATENT DOCUMENTS

| | | | |
|---|---|---|---|
| EP | 3085660 | A1 | 10/2016 |
| JP | H0624667 | A | 2/1994 |
| JP | 2829194 | B2 | 11/1998 |
| WO | 2018095739 | A1 | 5/2018 |

* cited by examiner (a)

(b)

(c)

ALIGNING DEVICE AND METHOD FOR ALIGNING A GUIDE RAIL OF AN ELEVATOR SYSTEM

FIELD

The present invention relates to an aligning device for aligning a guide rail of an elevator system. The invention also relates to a method for aligning a guide rail of an elevator system and to an elevator system equipped with the aligning device.

BACKGROUND

In elevator systems, elevator cars are generally moved vertically within an elevator shaft between different levels or floors. The elevator car is generally guided by one or more guide rails during the movement of the car. A guide rail is therefore anchored to a side wall of the guide shaft. The guide rail must be able to absorb the forces exerted on it by the elevator car, mainly in the horizontal direction, and to transfer them to the elevator shaft wall. The same guide rails or additional guide rails can be used to guide one or more counterweights during their movement through the elevator shaft.

In order to be able to precisely guide the elevator car and/or the counterweight, the guide rails generally have to be aligned very precisely. The guide rails should generally be fastened to the elevator shaft walls so as to extend exactly vertically, i.e. perpendicularly. Deviations from a precise positioning or orientation of the guide rails should be as small as possible, for example less than a few millimeters, in order to be able to keep wear-promoting loads on components of the elevator system low when moving the elevator car and/or the counterweight and/or in order to reduce vibrations on the elevator car caused by the guide on the guide rails during travel of the car and thus improve the comfort of the elevator system.

Conventionally, guide rails are fastened to shaft walls using rail bracket parts. Typically, a lower rail bracket part is fastened directly to one of the shaft walls, for example by being screwed to dowels or counterparts that have been previously cast in concrete. An upper rail bracket part is then attached to the lower rail bracket part. The rails should then be able to be fastened to the upper rail bracket part. Before the upper rail bracket part is firmly fixed to the lower rail bracket part, for example by using screws, both parts can be moved relative to one another. By moving the two rail bracket parts in relation to one another in this way, the upper rail bracket part can be brought into such a position and/or orientation that the guide rail attached or to be attached can be arranged at a desired positioning within the elevator shaft.

To date, within the context of assembling an elevator system, the lower rail bracket parts have mostly been fastened at suitable positions within the elevator shaft, then the upper rail bracket parts are loosely attached to the lower rail bracket parts and the guide rails are fixed to the upper rail bracket parts. The upper rail bracket parts can then be moved laterally relative to the lower rail bracket parts, for example by a few millimeters or even a few centimeters, for example by shaking the guide rail fastened to the upper rail bracket parts or by the guide rail being moved in the desired direction by lateral hammer blows.

WO 2018/095739 A1 describes a method and an aligning device for mounting or aligning a guide rail in an elevator shaft. JP 2829194 B2 (corresponding to JPH06024667A) describes a device and a method for aligning and fixing elevator guide rails.

Aligning guide rails in a guide shaft was previously difficult to implement with high precision and/or required an experienced installer.

SUMMARY

Among other things, there may be a need for an aligning device and a method for aligning a guide rail of an elevator system using the aligning device with which the guide rail can be aligned simply and/or with high precision with regard to its positioning and/or orientation. Furthermore, there may be a need for an elevator system having such an aligning device.

A need of this kind can be met by the subject matter according to any of the advantageous embodiments defined in the following description.

According to a first aspect of the invention, an aligning device for aligning a guide rail of an elevator system is described. The aligning device has at least two rail bracket parts in the form of a lower rail bracket part and an upper rail bracket part and at least one first and one second movement element. The lower rail bracket part is configured to be fixed to a shaft wall of an elevator shaft. The upper rail bracket part is configured to hold a guide rail of the elevator system that is fixed to the upper rail bracket part. The lower rail bracket part and the upper rail bracket part each have a connecting region and can be fixed to one another via the respective connecting regions. The movement elements are configured to move the lower rail bracket part relative to the upper rail bracket part. Each of the movement elements interacts both with the connecting region of the lower rail bracket part and with the connecting region of the upper rail bracket part, wherein the movement element is rotatable about an axis of rotation and interacts, eccentrically with respect to the axis of rotation, with at least one of the rail bracket parts so as to abut laterally opposite contact surfaces in the connecting region of this rail bracket part.

According to a second aspect of the invention, an elevator system having an elevator car guided in its vertical movement by a guide rail and an aligning device according to an embodiment of the first aspect of the invention is described. The lower rail bracket part is fastened to a shaft wall and the guide rail is fastened to the upper rail bracket part.

According to a third aspect of the invention, a method for aligning a guide rail of an elevator system is described, wherein the guide rail is fastened to the upper rail bracket part of an aligning device according to an embodiment of the first aspect of the invention. The method here comprises aligning the guide rail by moving the upper rail bracket part relative to the lower rail bracket part of the aligning device by rotating at least one of the movement elements of the aligning device.

Possible features and advantages of embodiments of the invention can be considered, among others and without limiting the invention, to be based upon the concepts and findings described below.

As already indicated in the introduction, the aligning of a guide rail of an elevator system is intended to be simplified and/or carried out more precisely, for example in the context of assembly or maintenance.

To summarize briefly, an aligning device in which two rail bracket parts can be moved relative to one another using two movement elements designed as eccentrics is proposed for this purpose. The movement elements interact with the two connecting regions of each of the rail bracket parts and can be rotated about an axis of rotation. At least one eccentrically designed part of a movement element laterally abuts a contact surface in the connecting region of one of the rail bracket parts so that when the movement element is rotated about its axis of rotation, the eccentrically designed part of the movement element laterally moves the contact surface and thus the connecting region of each rail bracket part. The movement element can be rotated simply and precisely using a tool, for example, and the rotational movement can be easily and intuitively converted into a lateral movement of the two rail bracket parts relative to one another.

The two rail bracket parts can be mechanically highly resilient components in order to be able to absorb the forces exerted on the guide rail held on the bracket parts by the elevator car to be guided or the counterweight to be guided without damage and to be able to transfer them to an elevator shaft wall, for example. The rail bracket parts can, for example, be made of metal, in particular steel. Each of the rail bracket parts can be in one piece. For example, a rail bracket part can be formed from sheet metal, in particular a thick steel sheet.

The rail bracket parts can be designed as a lower rail bracket part and as an upper rail bracket part. The two rail bracket parts can have the same, a similar or a different configuration. The lower rail bracket part is designed to be fixed to a shaft wall of an elevator shaft. The lower rail bracket part can be attached directly to the shaft wall. Alternatively, the lower rail bracket part can also be fastened to the shaft wall using additional components such as, for example, intermediate pieces, holders or the like. For this purpose, the lower rail bracket part can, for example, have recesses through which screws or other fastening elements can extend. In a similar way, the upper rail bracket part can be designed in such a way that a guide rail of the elevator system can be fixed and held on the upper rail bracket part. Here, too, direct or indirect attachment is possible and, for example, recesses can be provided through which screws or similar fastening elements used for fastening can be received. A predetermined arrangement of the two rail bracket parts with respect to one another cannot be derived from the terms lower rail bracket part and upper rail bracket part. These designations are only used to distinguish the two rail bracket parts.

Each of the two rail bracket parts has a connecting region. The two rail bracket parts can be fixed to one another via their two connecting regions. The connecting regions have sufficient mechanical strength to be able to absorb and transmit the forces acting on the rail bracket parts. In particular, the connecting regions can be formed in one piece with the rest of the associated rail bracket part. For example, a connecting region can be a partial region of a sheet metal from which the rail bracket part is formed. According to an embodiment, the connecting region can be planar, i.e. extend along a plane. In particular, a rail bracket part can be designed as an angle component, i.e. having an L-shaped cross section. In this case, the connecting region can be formed by a leg of this angle component.

When the two rail bracket parts are fixed to one another, their respective connecting regions can extend in parallel with one another. This applies in particular to planar connecting regions. The two connecting regions can directly adjoin one another, i.e. touch one another. Alternatively, an intermediate layer, a supplementary component or the like can be placed between the two connecting regions. The two connecting regions should be designed in such a way that the two rail bracket parts can be moved relative to one another parallel to a surface of their connecting regions.

In order to be able to fix the two rail bracket parts to one another, recesses can be provided in each of their connecting regions through which fixing elements can extend. Using such fixing elements, the two connecting regions can be mechanically pressed against one another or mechanically braced with one another and thus fixed to one another. For example, screws, bolts or the like can be used as fixing elements. The fixing elements can, for example, directly engage or interact with one of the connecting regions by means of a thread or the like. Alternatively, the fixing elements can be equipped with suitable counterparts such as nuts, split pins, quick-release fasteners or the like in order to be able to mechanically brace connecting regions extending between them against one another. In a possible embodiment, a fixing element can also be designed in one piece with one of the connecting regions or on one of the rail bracket parts. As a further possible embodiment, one of the movement elements can also be designed in such a way that it can also additionally act as a fixing element.

A main function of the movement elements is to be able to move the two rail bracket parts relative to one another. For this purpose, a movement element interacts both with the connecting region of the lower rail bracket part and with the connecting region of the upper rail bracket part. The movement element can be rotated about an axis of rotation. In the assembled state, the axis of rotation is preferably aligned orthogonally to a plane of extension of one of the connecting regions.

Here, the movement element is designed, at least in partial regions, in such a way that it interacts eccentrically with at least one of the rail bracket parts. When the movement element is rotated about its axis of rotation relative to the rail bracket part, it abuts laterally opposite contact surfaces in the connecting region of the rail bracket part with lateral surfaces of the eccentrically formed partial region. Since the eccentrically formed partial region is moved laterally due to the rotation of the movement element, a laterally acting force is exerted on the contact surfaces of each rail bracket part by its lateral surfaces. Due to this laterally acting force, the two rail bracket parts are moved relative to one another.

Ultimately, a linear movement of the two rail bracket parts relative to one another can be brought about by a simple and precise rotary movement of the movement element.

According to a specific embodiment, a round hole can be formed in the connecting region of a first of the rail bracket parts and an elongate hole can be formed in the connecting region of a second of the rail bracket parts. The movement element can have a cylindrical first engagement region centered around the axis of rotation and a cylindrical second engagement region which is arranged eccentrically around the axis of rotation. The movement element can then extend, together with the first engagement region, through the round hole of the first rail bracket part and can extend, together with the second engagement region, through the elongate hole of the second rail bracket part.

In other words, a round hole, i.e. a substantially cylindrical through opening, can be formed in one of the rail bracket parts and an elongate hole, i.e. a through opening with an elongate cross section, can be formed in a position corresponding to this in the other rail bracket part. Both an inner circumference of the round hole and at least parts of an inner circumference of the elongate hole form contact surfaces via which forces acting in the lateral direction can be exerted on the rail bracket parts or their connecting regions.

One of the movement elements can then have a first and a second engagement region. Both engagement regions can be designed to be substantially cylindrical. The engagement regions possibly have structures near the surface, such as threads, for example, the dimensions of which are negligible compared to the overall dimensions of the engagement regions and only represent insignificant deviations from the cylindrical shape of these engagement regions.

The first engagement region extends so as to be centered around the axis of rotation of the movement element. A cross section of the first engagement region can substantially correspond to a cross section of the round hole in the connecting region of the upper rail bracket part. The first engagement region can thus be received within the round hole and rotate about the axis of rotation in the hole.

The second engagement region is arranged eccentrically with respect to the axis of rotation. A diameter of the second engagement region can substantially correspond to a distance between the opposing contact surfaces, as they are formed by the inner sides of the elongate hole in the connecting region of the associated rail bracket part. The second engagement region can thus be received within the elongate hole.

While oppositely directed regions of a surface on the outer circumference of the second engagement region abut the opposite contact surfaces of the elongate hole in the connecting region and can exert forces on the contact surfaces in order to move the associated rail bracket part laterally in a direction transverse to the longitudinal direction of the elongate hole, the second engagement region can be moved along the longitudinal direction of the elongate hole within the elongate hole without significant forces being exerted on the associated rail bracket part.

According to a specific embodiment, a plurality of round holes can be formed for each of the movement elements in the connecting region of the first of the rail bracket parts. The round holes can preferably be arranged along a straight line.

For example, corresponding to each of the movement elements, two, three, four, five or more round holes can be provided in the connecting region of the first of the rail bracket parts. The associated movement element can accordingly extend through one of these round holes. The relative positioning between the first and the second connecting region and thus between the two rail bracket parts can thus be varied as required. The round holes can be adjacent to one another. The round holes can be arranged next to one another along a line, in particular along a straight line. Distances can be provided between the round holes. The distances can be larger, equal to or smaller than a diameter of the round holes. Alternatively, the round holes can overlap along the straight line so that a kind of elongate hole having a locally varying width results.

According to an embodiment, the first movement element can interact, eccentrically with respect to the axis of rotation, with at least one of the rail bracket parts so as to abut mutually parallel first contact surfaces and the second movement element can interact, eccentrically with respect to the rotation axis, with at least one of the rail bracket parts so as to abut mutually parallel second contact surfaces. The first contact surfaces can extend in a first direction and the second contact surfaces can extend in a second direction. The first and second directions may not be parallel to one another, i.e. extend at an angle other than zero to one another. In particular, the first and the second directions can be orthogonal to one another, i.e. extend at right angles to one another.

In other words, the at least two movement elements of the aligning device can be designed eccentrically such that each of the movement elements interacts, for example by its eccentrically arranged second engagement region, with contact surfaces on the connecting region of the associated movement element. In this case, however, the contact surfaces, with which the first movement element interacts, and the contact surfaces, with which the second movement element interacts, are not arranged in parallel with one another, but at an angle to one another.

Accordingly, forces can be exerted in different lateral directions on the associated contact surfaces and thus on the associated rail bracket part from the movement elements via their respective eccentric engagement regions by rotating each movement element. The first contact surfaces and the second contact surfaces are preferably arranged orthogonally to one another.

Due to the alignment of the first and second contact surfaces at an angle to one another, forces can be exerted on the first contact surfaces by rotating one movement element in a first direction and forces can be exerted on the second contact surfaces by rotating the other movement element in a second direction which is transverse, in particular orthogonal, to the first direction. The rail bracket parts can thus be moved relative to one another in a plane parallel to the surfaces of their connecting regions in two spatial directions which extend perpendicularly to one another.

According to an embodiment, the aligning device can also have a third movement element.

The third movement element can be designed in the same or in a similar way to the other two movement elements and interact in the same or in a similar way with the connecting regions of the rail bracket parts. In particular, like the other two movement elements, the third movement element can have first and second engagement regions and extend through additional round and elongate holes provided for this purpose in the connecting regions of the rail bracket parts.

Using the third movement element, further forces can be exerted on the rail bracket parts in order to move them relative to one another. These further forces can in particular be directed and used in such a way that the rail bracket parts can not only be moved linearly relative to one another, but also can be reoriented relative to one another by a rotary movement.

In this case, according to an embodiment, the third movement element can interact, eccentrically with respect to the axis of rotation, with at least one of the rail bracket parts so as to abut mutually parallel third contact surfaces. The first and third contact surfaces can extend in mutually parallel directions.

In other words, two elongate holes can be formed in one of the connecting regions of the two rail bracket parts, the inner surfaces of which form the first and third contact surfaces. These two elongate holes can extend with their respective longitudinal direction in the same direction or in mutually parallel directions. Thus, by rotating the first and the third movement element via their respective eccentrically arranged engagement regions, forces can be exerted on the corresponding connecting region in mutually parallel directions transversely to each of the first and third contact surfaces.

Since the two elongate holes are preferably arranged in mutually offset positions with respect to their longitudinal direction, a torque can be produced on the corresponding connecting region using such forces. Due to such an induced torque, the two rail bracket parts can be reoriented relative to one another by appropriately rotating the first and the third movement element.

In principle, this can also be achieved if the first and third contact surfaces are not arranged in directions which extend in parallel with one another. In the event that the first and third contact surfaces are arranged in mutually parallel directions, the rail bracket parts can be rotated relative to one another in a manner that is particularly intuitive for a technician by the laterally spaced first and third movement elements being rotated about their respective axes.

According to an embodiment, each of the movement elements has a screw head with which a tool can interact in order to rotate the movement element about its axis of rotation.

In other words, a structure can be provided at one end of one of the movement elements, by means of which a tool can come into engagement in order to be able to exert a torque on the movement element about the axis of rotation of the movement element. For example, the screw head can be designed as a polygon, for example a hexagon, with which a correspondingly angular tool wrench can interact. Using the tool, a technician can apply a torque to each movement element easily, precisely and, if necessary, with high forces.

According to an embodiment, the movement element has a thread centered around the axis of rotation.

In other words, a thread can be provided, for example, at one end of the movement element. The thread can extend spirally around the axis of rotation of the movement element. For example, a nut can be screwed onto the thread, by means of which the movement element can be held on one of the connecting regions of the rail bracket parts or can be supported on the region. Alternatively, the movement element can be screwed by the thread into a thread that is provided on one of the connecting regions of the rail bracket parts.

According to an embodiment, the aligning device also has an actuator system which is configured to rotate the movement elements independently of one another about their respective axes of rotation.

In other words, the aligning device can have an actuator system having one or more actuators. An actuator can interact with one of the movement elements. Alternatively, an actuator can selectively interact with various movement elements via a transmission. The actuator or the actuators can each interact with one of the movement elements in order to rotate it about its axis of rotation in order to effect a movement of the two rail bracket parts relative to one another in this way.

Since the actuator system is configured to be able to rotate the movement elements independently of one another, and since the movement elements preferably interact with the connecting regions of the rail bracket parts in such a way that rotating each movement element causes a relative movement of the two connecting regions in a different direction than that caused by other movement elements, a desired movement of the two rail bracket parts relative to one another can be brought about by targeted actuation of the actuator system and thus targeted rotation of the various movement elements.

According to a specific embodiment, the actuator system has one or more electric motors in order to rotate the movement elements independently of one another about their respective axes of rotation. Each electric motor can act as an actuator to rotate one or more of the movement elements. A number of electric motors can preferably be equal to a number of the movement elements and an electric motor can be assigned to each movement element.

According to a further specific embodiment, the actuator system has a controller to control a rotation of the movement elements in such a way that the upper rail bracket part is moved relative to the lower rail bracket part toward a reference position.

In other words, a controller can be provided for the actuator system, by means of which an operation of the actuator or actuators can be controlled. The controller can know the reference position at which, for example, the guide rail held on the upper rail bracket part should be arranged. On the basis of the information about the reference position, the controller can then rotate the movement elements of the aligning device by suitably controlling the actuators in such a way that the upper rail bracket part, possibly together with the guide rail attached thereto, is moved toward the reference position. The reference position can be determined, for example, by measuring a lateral distance toward a previously clamped perpendicular.

Embodiments of the aligning device described herein can be used for an elevator system according to an embodiment of the second aspect of the invention. The elevator system has an elevator car which, when it moves vertically through an elevator shaft, is guided laterally by at least one guide rail. In this case, the lower rail bracket part of the aligning device is used to be fastened to a shaft wall, whereas the guide rail is fastened to the upper rail bracket part.

Accordingly, using embodiments of the method also described herein according to the third aspect of the invention, a position and/or orientation of the guide rail can be set by suitably aligning the upper rail bracket part by rotating one or more of the movement elements of the aligning device.

In particular, it is possible for more than one aligning device having an actuator system to be arranged on sliding bracket parts at the same time. In particular, at least three aligning devices having an actuator system are arranged on the sliding bracket parts of a guide rail. It is particularly advantageous if an aligning device having an actuator system is arranged on each pair of rail bracket parts of a guide rail.

The arrangement of a plurality of aligning devices having an actuator system on a guide rail makes a particularly precise automated aligning of the guide rail possible, since an aligning on one rail bracket part can influence a previous aligning of the guide rail on another rail bracket part. The arrangement of a plurality of aligning devices having an actuator system on different rail bracket parts of a guide rail makes either simultaneous aligning on different guide rail parts possible or a quick check of the effects of an aligning on one rail bracket part on the previous aligning on another rail bracket part possible. The guide rail can, for example, be aligned automatically in an iterative process in which a repeated aligning on different rail bracket parts takes place one after the other.

It is noted that some of the possible features and advantages of the invention are described herein with reference to different embodiments of the aligning device, the elevator system equipped therewith or the aligning method to be carried out therewith. A person skilled in the art recognizes that the features can be combined, adapted, transferred or exchanged in a suitable manner in order to arrive at further embodiments of the invention.

Embodiments of the invention will be described in the following with reference to the accompanying drawings, with neither the drawings nor the description being intended to be interpreted as limiting to the invention.

The drawings are merely schematic and not to scale. Like reference signs refer to like or equivalent features in the various drawings.

DETAILED DESCRIPTION

Figure 1:
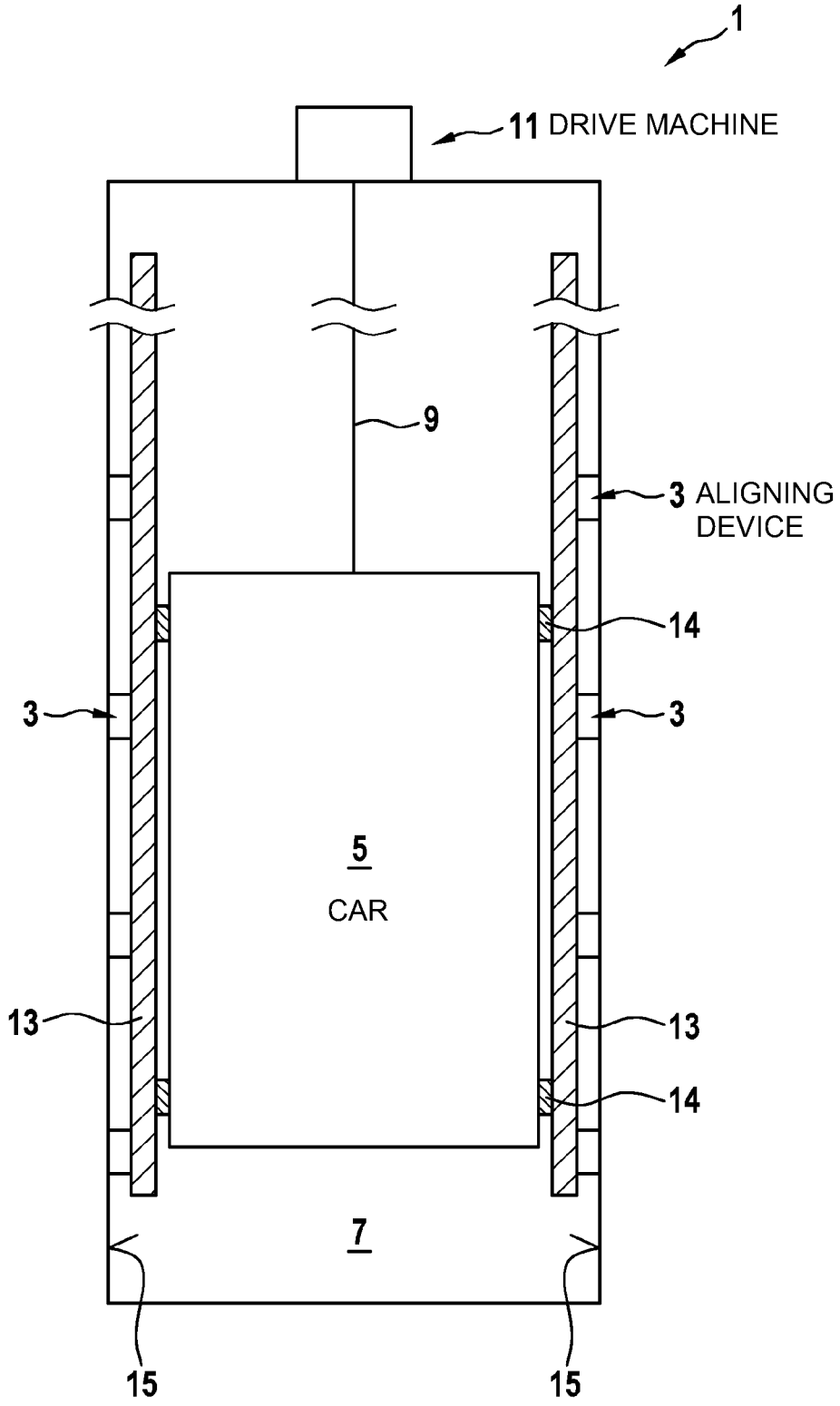
FIG. 1 shows an elevator system according to an embodiment of the present invention.

FIG. 1 shows an elevator system 1 having an aligning device 3 according to an embodiment of the present invention.

In the elevator system 1, an elevator car 5 can move vertically within an elevator shaft 7. It is moved by means of a rope-like suspension element 9 which is driven by a drive machine 11.

In particular, in order to prevent the elevator car 5 from lateral movements such as for example swinging within the elevator shaft 7, it is guided by guide rails 13 during its vertical movement. The elevator car 5 is supported on the guide rails 13 via guide shoes 14 or the like. The guide rails 13 are each anchored on a shaft wall 15. In order to simplify correct positioning of the guide rails 13 or to be able to change them later, the guide rails 13 are not attached directly to the shaft wall 15, but are connected to it via one of the aligning devices 3.

In FIGS. 2 to 5, an embodiment of an aligning device 3 is shown in different views. The aligning device 3 has two rail bracket parts 17.

One of the rail bracket parts 17 is used as the lower rail bracket part 19 to be fixed to the shaft wall 15. For this purpose, the lower rail bracket part 19 has suitable recesses 21 in the form of elongate holes 23 and/or round holes 25. Fastening elements, such as screws, by means of which the lower rail bracket part 19 can be anchored to the shaft wall 15, can extend through these recesses 21.

The other rail bracket part 17 is used as the upper rail bracket part 27 to hold the guide rail 13 to be fixed thereon. For this purpose, for example, suitable recesses 29 in the form of elongate holes 31 and/or round holes (not shown) can also be provided on the upper rail bracket part 27.

Each of the rail bracket parts 17 can be designed as a component with an L-shaped cross section. For example, the rail bracket parts 17 can be designed as curved and thick steel sheets provided with the recesses 21, 29. The recesses 21, 29 each extend through one of the legs of such an L-shaped component. Each different leg of the component forms a connecting region 33, 35. The lower rail bracket part 19 can be connected by its connecting region 33 to the connecting region 35 of the upper rail bracket part 27 so that the two rail bracket parts 17 are fixed to one another.

A plurality of movement elements 37', 37", 37'" (generically 37) extend between the lower rail bracket part 19 and the upper rail bracket part 27. The movement elements 37', 37", 37'" are configured to move the lower rail bracket part 19 relative to the upper rail bracket part 27 laterally, i.e. in parallel with the planes of extension of their connecting regions 33, 35. Each of the movement elements 37', 37", 37'" interacts both with the connecting region 33 of the lower rail bracket part 19 and with the connecting region 35 of the upper rail bracket part 27. As described in more detail below with reference to FIG. 6, the movement elements 37', 37", 37'" are designed as components which are eccentrically designed at least in partial regions. A movement element 37', 37", 37'" is rotatable about an axis of rotation 39 and interacts, eccentrically with respect to the axis of rotation 39, with at least one of the rail bracket parts 17 so as to abut laterally opposite contact surfaces 41', 41", 41'" in the connecting region 35 of this rail bracket part 27.

In the example shown, a round hole 43', 43", 43'" is provided in the connecting region 33 of the lower rail bracket part 19 for each of three movement elements 37', 37", 37'". At positions corresponding to this, elongate holes 45', 45", 45'" are provided in the connecting region 35 of the upper rail bracket part 27. The round holes 43', 43", 43'" and the elongate holes 45', 45", 45'" are arranged laterally next to one another and laterally spaced apart from one another.

Figure 6:
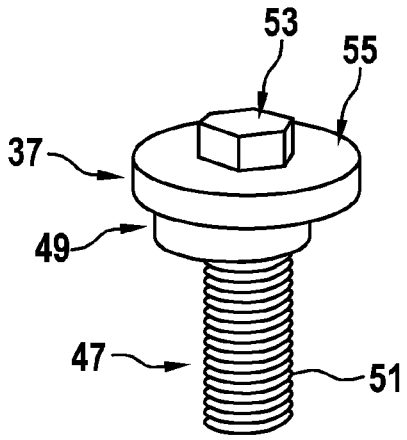
FIG. 6 (*a*)-(*c*) show different views of a movement element for an aligning device according to the invention.
Figure 6:
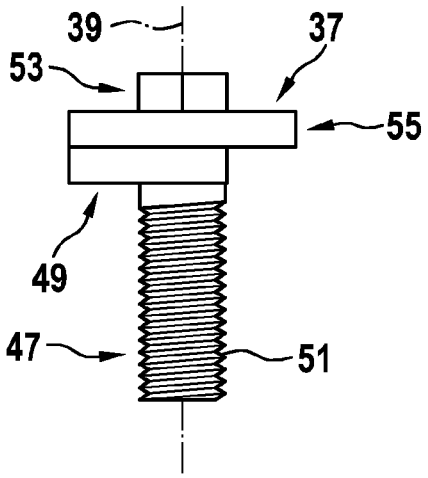
Figure 6:
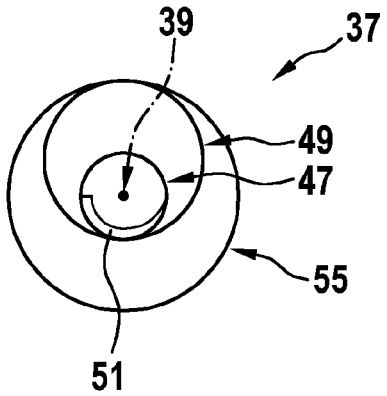

As illustrated in FIGS. 6(*a*)-(*c*), each of the movement elements 37 has a cylindrical first engagement region 47 and a preferably likewise cylindrical second engagement region 49. The first engagement region 47 extends centered around the axis of rotation 39, whereas the second engagement region 49 is formed eccentrically with respect to the axis of rotation 39. A diameter of the second engagement region 49 is considerably larger than a diameter of the first engagement region 47. The first engagement region 47 is provided with a thread 51. On a side opposite the first engagement region 47, a stop region 55 is located adjacently to the second engagement region 49. This stop region 55 can also be cylindrical. The stop region 55 can have a significantly larger diameter than the second engagement region 49. The movement element 37 also has a screw head 53 with which a tool can interact in order to be able to rotate the movement element 37 about its axis of rotation 39.

Figure 2:
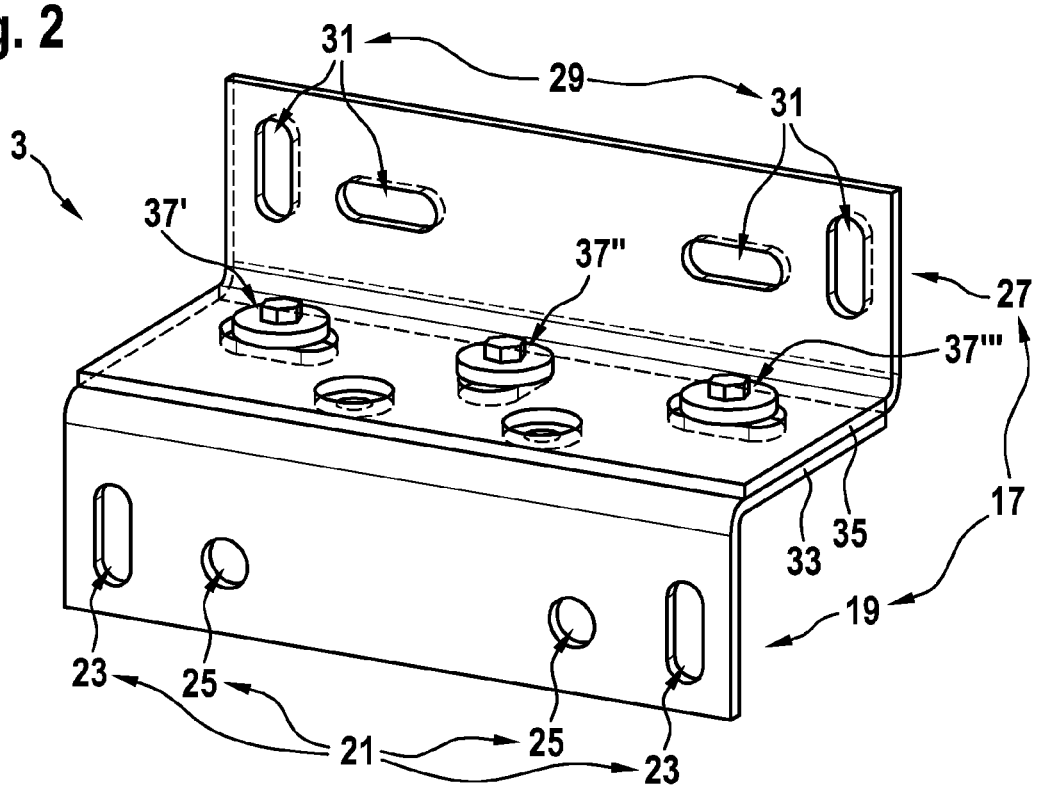
FIG. 2 shows a perspective view of an aligning device according to an embodiment of the present invention.
Figure 3:
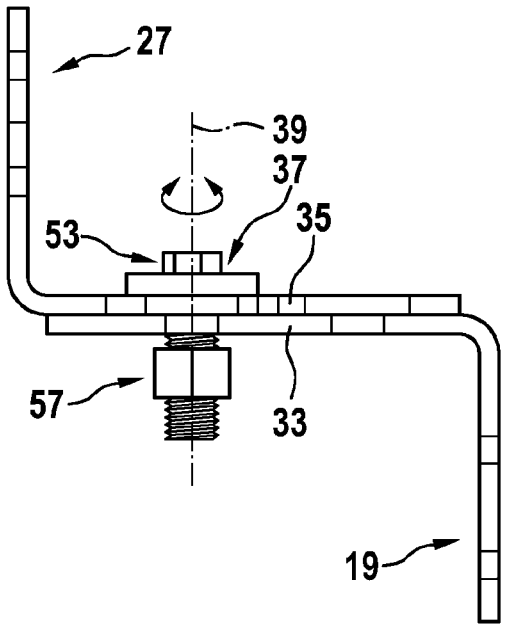
FIG. 3 shows a sectional view through the aligning device from FIG. 2.
Figure 4:
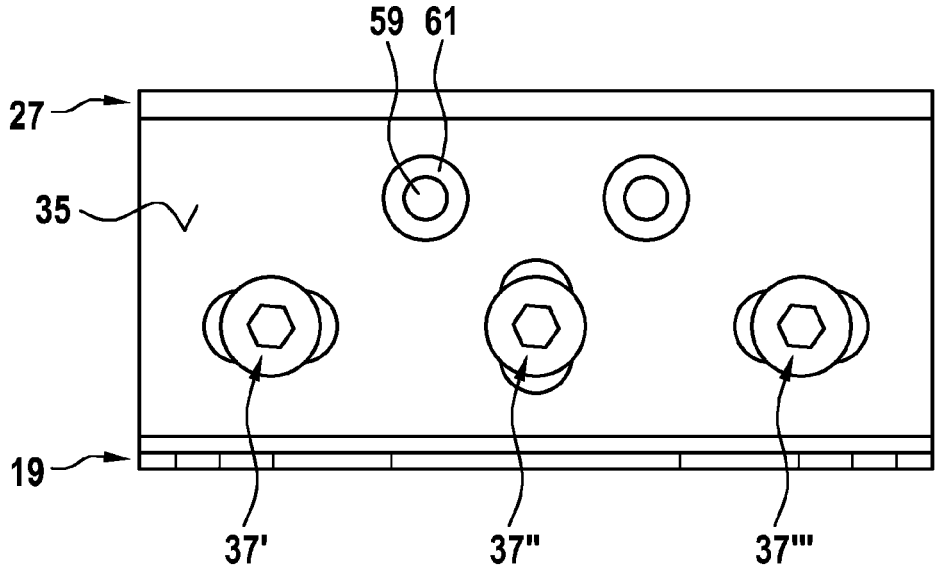
FIG. 4 shows a plan view of the aligning device from FIG. 2.
Figure 5:
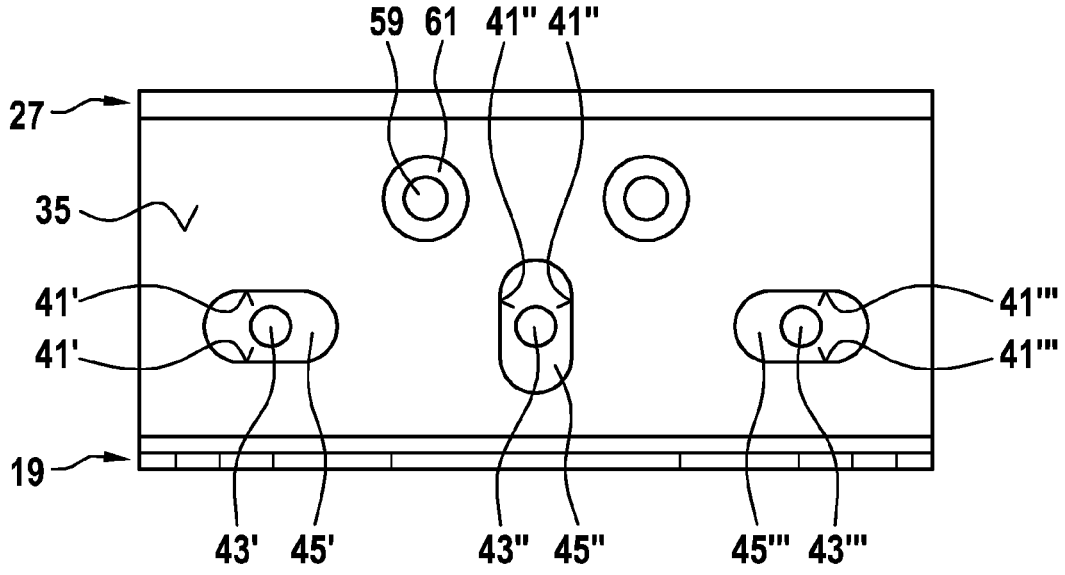
FIG. 5 shows the plan view from FIG. 4 with the movement elements removed.

In the assembled state (as shown in FIGS. 2-4), each of the movement elements 37', 37", 37'" is arranged in such a way that its first engagement region 47 extends through an associated round hole 43', 43", 43'" in the connecting region 33 of the lower rail bracket part 19 and its second engagement region 49 extends through an associated elongate hole 45', 45", 45'" in the upper rail bracket part 27. A diameter of the round hole 43', 43", 43'" corresponds substantially to a diameter of the first engagement region 47 so that the movement element 37 engages form-fittingly into the round hole 41', 41", 41'" with its first engagement region 47 in relation to the extension plane of the connecting region 33. A width of the elongate hole 45', 45", 45'" corresponds substantially to a diameter of the second engagement region 49. Inner longitudinal sides of the elongate hole 45', 45", 45'" form the contact surfaces 41', 41", 41'" on which the movement element 37 rests laterally with its second engagement area 49. A length of the elongate hole 45', 45", 45'" is significantly greater than its width so that the second engagement region 49 together with the entire movement element 37', 37", 37'" within the elongate hole 45', 45", 45'" can be moved along each longitudinal extension direction and thus in parallel with the respective contact surfaces 41', 41", 41'".

By rotating one of the movement elements 37', 37", 37'" about its axis of rotation 39, a force can be exerted on the contact surface 41', 41", 41'" that interacts with this second engagement region 49 due to the laterally displaced second engagement region 49 of the associated elongate hole 45', 45", 45'". In other words, by rotating the movement element 37, a laterally acting force between the two connecting regions 33, 35 of the rail bracket parts 17 can be generated by an eccentric effect. Using this force, the rail bracket parts 17 can be moved relative to one another. A direction and a degree of such a relative movement can be influenced, depending on which of the three movement elements 37', 37", 37'" is rotated how much. The rail bracket parts 17 can be moved linearly in different spatial directions parallel to an interface between their connecting regions 33, 35. In addition, the rail bracket parts 17 can be rotated relative to one another by suitable actuation of movement elements 37', 37", 37'".

After the rail bracket parts 17 have been brought into a desired position by suitable rotation of the movement elements 37', 37", 37'", they can be fixed to one another. For this purpose, for example, a nut 57 can be screwed and tightened onto the thread 51 of the movement element 37', 37", 37'". As an alternative or in addition, additional recesses, for example in the form of round holes 59, 61, can be provided in the two connecting regions 33, 35 through which fixing elements such as screws can extend. Using nuts 57 and/or fixing elements, the two connecting regions 33, 35 can be mechanically pressed against one another and thus fixed relative to one another.

In the embodiment shown in FIGS. 2-5, the three elongate holes 45', 45", 45'" are aligned in such a way that the contact surfaces 41', 41", 41'" of adjacent elongate holes 45', 45", 45'" extend in directions that are not parallel to one another. For example, the contact surfaces 41' of the first elongate hole 45' extend perpendicularly to the contact surfaces 41" of the adjacent second elongate hole 45". The contact surfaces 41', 41'" of the two outer and therefore not directly adjacent elongate holes 45', 45'" extend in mutually parallel directions.

With such an arrangement of elongate holes 45', 45", 45'" and movement elements 37', 37", 37'" extending through them, an alignment of the upper rail bracket part 27 relative to the lower rail bracket part 19 can, for example, be carried out by a technician in particular in an intuitive manner. For example, in order to move the upper rail bracket part 27 to the left or right (with reference to the illustration in FIG. 4), the middle movement element 37" must be rotated accordingly. If the upper rail bracket part 27 is to be moved upward or downward, both external movement elements 37', 37'" should be rotated in the same way. If the upper rail bracket part 27 is to be reoriented, i.e. rotated in its orientation relative to the lower rail bracket part 19, the two external movement elements 37', 37'" should be rotated in opposite directions.

Figure 7:
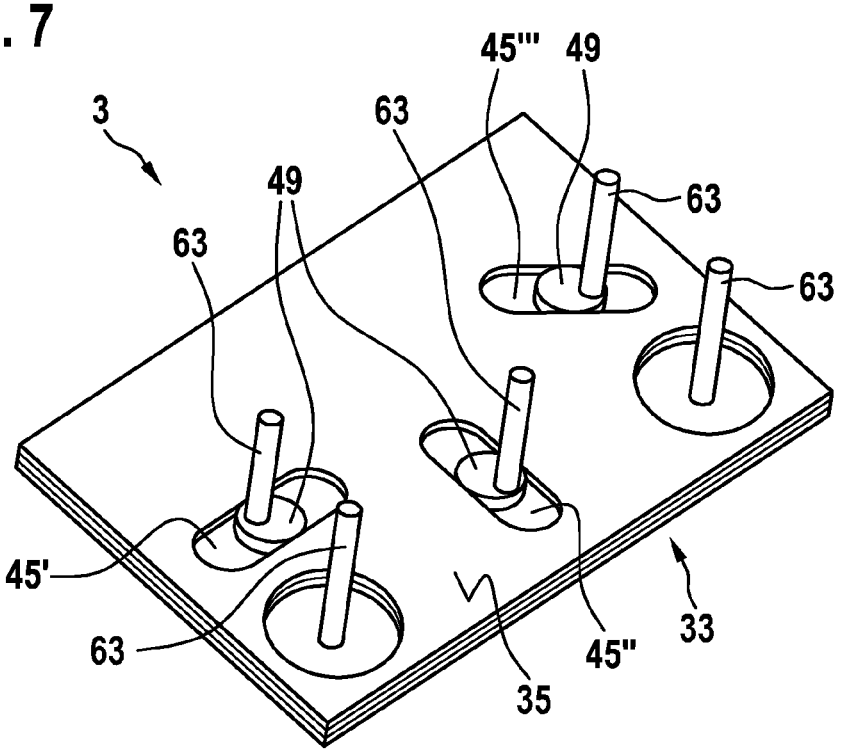
FIG. 7 shows a design of connecting regions of an aligning device according to an alternative embodiment of the present invention.

FIG. 7 shows a perspective view of connecting regions 33, 35 of an alternative embodiment of an aligning device 3. A plurality of pins 63 are coupled to the connecting region 33 of the lower rail bracket part 19. At least three of these pins 63 are held so as to be rotatable relative to the connecting region 33 of the lower rail bracket part 19. These pins 63 can either interact directly with the connecting region 33 of the lower rail bracket part 19 by, for example, engaging in round holes provided there (not shown in FIG. 7). Alternatively, although the pins 63 cannot themselves engage in the connecting region 33 of the lower rail bracket part 19, they can interact indirectly with this connecting region 33. For example, these pins 63 can interact mechanically with others of the pins 63 which engage in the connecting region 33 of the lower rail bracket part 19.

In the example shown in FIG. 7, two elongate holes 45', 45" extend in mutually perpendicular directions, whereas a third elongate hole 45"" extends obliquely, in particular at a 45° angle, to the other two elongate holes 45', 45".

Figure 8:
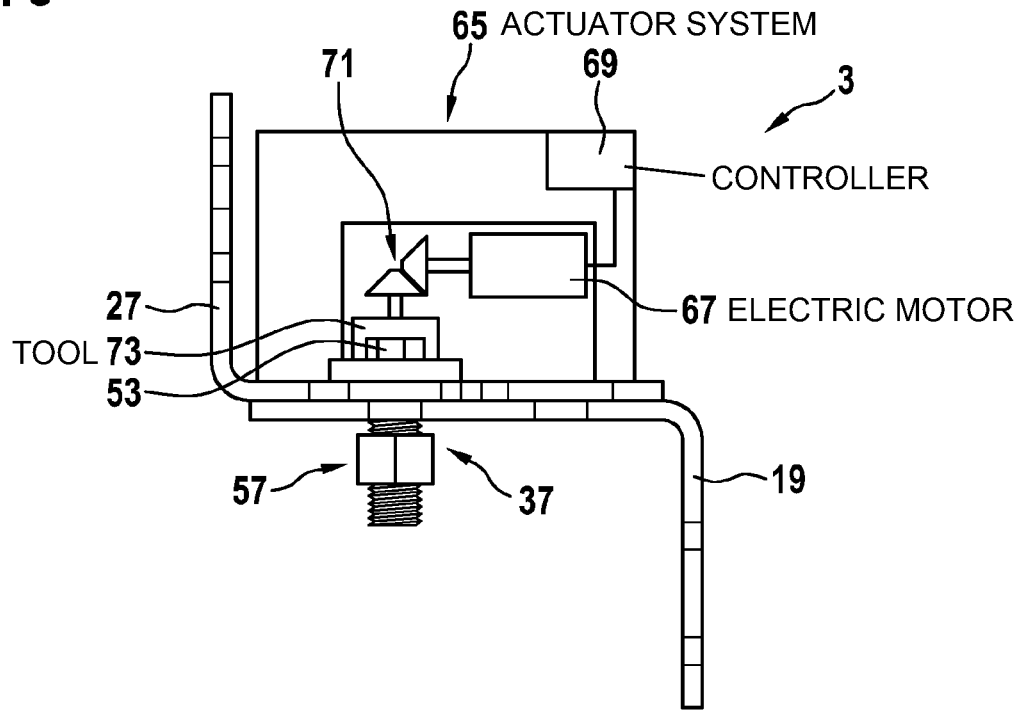
FIG. 8 shows an aligning device according to the invention having an actuator system.

In FIG. 8, an embodiment of an aligning device 3 is shown schematically, which has an actuator system 65. The actuator system 65 has an electric motor 67 which is controlled by a controller 69. The electric motor 67 interacts with a tool 73 via a transmission 71. The tool 73 in turn interacts with the screw head 53 of the movement element 37.

Using the electric motor 67 and controlled by the controller 69, the movement element 37 can thus be rotated automatically by means of the actuator system 65. A separate electric motor 67 can be provided for each of the movement elements 37 so that the movement elements 37 can be rotated about their respective axes of rotation independently of one another. Alternatively, a single electric motor 67 can be sufficient to be able to selectively rotate individual movement elements 37 using a transmission arrangement likewise to be controlled by the controller 69, for example.

Optionally, the controller 69 can have information regarding a reference position to be reached in the course of an aligning process. In this case, the controller can possibly automatically actuate the rotation of the movement elements 37 using the electric motors 67. An aligning process can thus be largely or even completely automatic.

It is possible for more than one aligning device having an actuator system to be arranged on sliding bracket parts at the same time. In particular, an aligning device having an actuator system is arranged on each pair of rail bracket parts of a guide rail. This makes either a simultaneous alignment on different guide rail parts possible or a quick check of the effects of an alignment on one rail bracket part on the previous alignment on another rail bracket part possible. The guide rail is then aligned automatically in an iterative process in which a repeated alignment on different rail bracket parts takes place one after the other.

Figure 9:
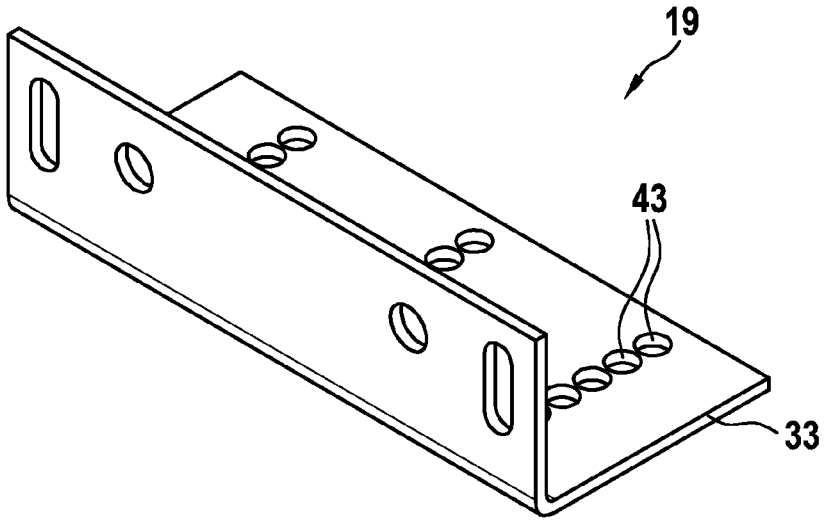
FIG. 9 shows a lower rail bracket part having a plurality of round holes formed therein.

FIG. 9 shows a lower rail bracket part 19, in the connecting region 33 of which a plurality of round holes 43 are formed. A plurality of round holes 43 are provided for each of the movement elements 37. The round holes 43 provided for a movement element 37 are arranged adjacent to one another along a straight line. The straight lines relating to round holes 43 for adjacent movement elements 37 extend substantially in parallel with one another. In the example shown, the round holes 43 are laterally spaced apart from one another. Alternatively, adjacent round holes 43 could partially overlap one another, i.e. a center-to-center distance between adjacent round holes 43 could be smaller than their diameter. Due to the plurality of available round holes 43, the upper rail bracket part 27 and the lower rail bracket part 19 can be roughly pre-positioned relative to one another at different positions, depending on which of the round holes 43 the associated movement element 37 is guided through.

By way of example only, dimensions of the rail bracket part 17 can be in a range of from a few centimeters or a few decimeters in the lateral direction and a few millimeters in a thickness direction. For example, in the example from FIG.

9, a length of the sheet metal used for the lower rail bracket part 19 can be 250 mm±30 mm and a width can be 110 mm±20 mm and a thickness of the sheet metal can be in the range of 5 mm±2 mm.

Finally, it should be noted that terms such as "comprising," "having," etc. do not preclude other elements or steps, and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An aligning device for aligning a guide rail of an elevator system, the aligning device comprising:

two rail bracket parts being a lower rail bracket part and an upper rail bracket part, wherein the lower rail bracket part is adapted to be fixed to a shaft wall of an elevator shaft of the elevator system and wherein the upper rail bracket part is adapted to hold the guide rail of the elevator system fixed to the upper rail bracket part;

at least two movement elements;

wherein the lower rail bracket part and the upper rail bracket part each have a connecting region for fixing the two rail bracket parts to one another;

wherein the movement elements each interact with the connecting regions to move the lower rail bracket part relative to the upper rail bracket part, each of the movement elements being rotatable about an axis of rotation thereof and interacting eccentrically with respect to the axis of rotation with at least one of the rail bracket parts so as to abut laterally opposite contact surfaces in the connecting region of the at least one rail bracket part;

and wherein a first of the movement elements interacts, eccentrically with respect to the axis of rotation thereof, with the at least one rail bracket part so as to abut mutually parallel first contact surfaces of the laterally opposite contact surfaces, and wherein a second of the movement elements interacts, eccentrically with respect to the axis of rotation thereof, with the at least one rail bracket part so as to abut mutually parallel second contact surfaces of the laterally opposite contact surfaces, wherein the first contact surfaces extend in a first direction and the second contact surfaces extend in a second direction, and wherein the first direction and the second direction are not parallel to one another.

2. The aligning device according to claim 1 wherein the connecting region of a first of the rail bracket parts has a round hole formed therein and the connecting region of a second of the rail bracket parts has an elongate hole formed therein, wherein one of the movement elements has a cylindrical first engagement region centered around the axis of rotation and a cylindrical second engagement region arranged eccentrically around the axis of rotation, and wherein the one movement element extends, together with the first engagement region, through the round hole of the first rail bracket part and extends, together with the second engagement region, through the elongate hole of the second rail bracket part.

3. The aligning device according to claim 2 wherein two pluralities of the round hole are formed in the connecting region of the first rail bracket part, and wherein the round holes in each of pluralities are arranged along a straight line for receiving one of the movement elements.

4. The aligning device according to claim 1 wherein the first direction and the second direction are orthogonal to one another.

5. The aligning device according to claim 1 including a third movement element that interacts, eccentrically with respect to an axis of rotation thereof, with the at least one rail bracket part so as to abut mutually parallel third contact surfaces of the laterally opposite contact surfaces, wherein the first contact surfaces and the third contact surfaces extend in mutually parallel directions.

6. The aligning device according to claim 1 wherein the connecting regions are planar.

7. The aligning device according to claim 1 wherein each of the movement elements has a screw head adapted to interact with a tool to rotate the movement element about the axis of rotation.

8. The aligning device according to claim 1 wherein each of the movement elements has a thread centered about the axis of rotation.

9. The aligning device according to claim 1 including an actuator system adapted to rotate the movement elements independently of one another about the respective axes of rotation.

10. The aligning device according to claim 9 wherein the actuator system includes at least one electric motor adapted to rotate the movement elements independently of one another about the respective axes of rotation.

11. The aligning device according to claim 9 wherein the actuator system includes a controller adapted to control rotation of the movement elements such that the upper rail bracket part is moved relative to the lower rail bracket part toward a predetermined reference position.

12. An elevator system having an elevator car guided in a vertical movement by a guide rail, the elevator system including the aligning device according to claim 1, wherein the lower rail bracket part is fastened to a shaft wall and the guide rail is fastened to the upper rail bracket part.

13. A method for aligning a guide rail of an elevator system, wherein the guide rail is fastened to the upper rail bracket part of the aligning device according to claim 1, the method comprising the steps of:

mounting the lower rail bracket part of the aligning device on a shaft wall of an elevator shaft of the elevator system; and aligning the guide rail in the elevator shaft by moving the upper rail bracket part relative to the lower rail bracket part by rotating at least one of the movement elements of the aligning device.

* * * * *